US008952671B2

(12) United States Patent
Shimizu et al.

(10) Patent No.: US 8,952,671 B2
(45) Date of Patent: Feb. 10, 2015

(54) POWER SUPPLY APPARATUS FOR TESTING APPARATUS

(71) Applicant: Advantest Corporation, Tokyo (JP)

(72) Inventors: Takahiko Shimizu, Tokyo (JP); Katsuhiko Degawa, Tokyo (JP)

(73) Assignee: Advantest Corporation, Tokyo (JP)

( * ) Notice: Subject to any disclaimer, the term of this patent is extended or adjusted under 35 U.S.C. 154(b) by 48 days.

(21) Appl. No.: 13/924,480

(22) Filed: Jun. 21, 2013

(65) Prior Publication Data

US 2014/0009129 A1 Jan. 9, 2014

(30) Foreign Application Priority Data

Jun. 28, 2012 (JP) ..... 2012-145859

(51) Int. Cl.
*G05F 1/40* (2006.01)
*G05F 1/625* (2006.01)
*G05F 1/575* (2006.01)

(52) U.S. Cl.
CPC ..... *G05F 1/625* (2013.01); *G05F 1/575* (2013.01)
USPC ..... 323/283

(58) Field of Classification Search
USPC ..... 323/265, 271, 273, 282, 283, 285; 341/141, 144, 155, 158, 159
See application file for complete search history.

(56) References Cited

U.S. PATENT DOCUMENTS

| | | | | |
|---|---|---|---|---|
| 5,184,061 | A * | 2/1993 | Lee et al. | 323/265 |
| 5,689,460 | A * | 11/1997 | Ooishi | 365/189.07 |
| 5,835,045 | A * | 11/1998 | Ogawa et al. | 341/155 |
| 6,370,075 | B1 * | 4/2002 | Haeberli et al. | 365/226 |
| 7,129,869 | B2 * | 10/2006 | Furuta et al. | 341/133 |
| 7,649,345 | B2 * | 1/2010 | Kwan | 323/283 |
| 7,852,058 | B2 * | 12/2010 | Kwan | 323/283 |
| 8,749,222 | B2 * | 6/2014 | Williams | 324/76.11 |
| 8,803,501 | B2 * | 8/2014 | Kodera et al. | 323/285 |

(Continued)

FOREIGN PATENT DOCUMENTS

| | | |
|---|---|---|
| JP | H07-311223 | 11/1995 |
| JP | 2001-041997 | 2/2001 |

*Primary Examiner* — Adolf Berhane
(74) *Attorney, Agent, or Firm* — Ladas & Parry, LLP

(57) ABSTRACT

A main reference value setting unit generates a voltage reference value $D_{REF_V}$ which represents a target level of a power supply voltage $V_{DD}$. A digital calculation unit generates a main control value $D_{OUT}$ by digital calculation such that a digital voltage measurement value $D_{M_V}$ which represents the voltage level of the current power supply voltage $V_{DD}$ matches the voltage reference value $D_{REF_V}$. A main D/A converter converts the main control value $D_{OUT}$ into an analog power supply signal $S_{PS}$, and supplies the analog power supply signal $S_{PS}$ thus generated to a power supply terminal of a DUT via a power supply line. An auxiliary current source supplies an auxiliary current $I_{SUB}$ to the power supply terminal of the DUT via a sub-path that differs from the power supply line.

19 Claims, 7 Drawing Sheets

(56) References Cited

U.S. PATENT DOCUMENTS

| | | | | |
|---|---|---|---|---|
| 2002/0031032 | A1* | 3/2002 | Ooishi | 365/226 |
| 2005/0047245 | A1* | 3/2005 | Furuta et al. | 365/222 |
| 2007/0052405 | A1* | 3/2007 | Mochizuki et al. | 323/316 |
| 2008/0252277 | A1* | 10/2008 | Sase et al. | 323/283 |
| 2009/0085538 | A1* | 4/2009 | Miguchi et al. | 323/273 |
| 2010/0289683 | A1* | 11/2010 | Kito | 341/144 |
| 2012/0182002 | A1* | 7/2012 | Takahashi et al. | 323/283 |

* cited by examiner

POWER SUPPLY APPARATUS FOR TESTING APPARATUS

CROSS-REFERENCE TO RELATED APPLICATION

This application claims priority from Japanese Patent Application No. 2012-145859, filed on Jun. 28, 2012, the disclosure of which is hereby incorporated by reference in its entirety.

BACKGROUND OF THE INVENTION

1. Field of the Invention

The present invention relates to a power supply apparatus configured to supply a power supply voltage or a power supply current to a device.

2. Description of the Related Art

A test apparatus includes a power supply apparatus configured to supply a power supply voltage or a power supply current to a device under test (DUT). FIG. 1 is a block diagram showing a schematic configuration of a power supply apparatus investigated by the present inventors. A power supply apparatus 1100 includes a power supply output unit 1026, and a frequency controller (which will be referred to as the "controller" hereafter) 1024 configured to control the power supply output unit 1026. For example, the power supply output unit 1026 is configured as an operational amplifier (buffer), a DC/DC converter, a linear regulator, or otherwise as a constant current source, and is configured to generate a power supply voltage or a power supply current (hereafter power supply signal $S_{PS}$) to be supplied to the DUT 1.

The power supply apparatus 1100 is configured to be capable of switching its mode between a voltage supply mode (VS) in which the voltage value $V_{DD}$ of the power supply signal $S_{PS}$ supplied to the DUT 1 is maintained at a constant value, and a current supply mode (IS) in which the current value $I_{DD}$ of the power supply signal is maintained at a constant value.

The controller 1024 is configured to output a control value such that the difference between the measurement value (value to be measured) which is a feedback value and a predetermined reference value (standard value) becomes zero. Examples of such a measurement value include a power supply voltage $V_{DD}$ supplied to the DUT 1, and a feedback signal $V_M$ that corresponds to the power supply current $I_{DD}$.

In order to detect the current $I_{DD}$ in the current supply mode or in the voltage supply mode, a detection resistor Rs and a sense amplifier 1028 are arranged. The detection resistor Rs is arranged on a path of the power supply signal $S_{PS}$. A voltage drop (detection voltage Vs) occurs between both terminals in proportion to the current $I_{DD}$. The sense amplifier 1028 is configured to amplify the detection voltage Vs so as to generate the measurement value $V_{M_I}$.

A selector 1030 is configured to select the measurement value $V_{M_V}$ of the voltage $V_{DD}$ in the voltage supply mode, and to select the measurement value $V_{M_I}$ of the current $I_{DD}$ in the current supply mode.

For example, a circuit component 1022 represented by a subtractor symbol shown in FIG. 1 is configured as an error amplifier (operational amplifier), and is configured to amplify the difference between the measurement value and the reference value. The analog controller 1024 is configured to generate the control value such that this difference becomes zero. The state of the power supply output unit 1026 is feedback controlled according to the control value. As a result, the power supply voltage $V_{DD}$ or otherwise the power supply current $I_{DD}$, which is used as a value to be controlled, is stabilized to the reference value.

A selector 1032 is configured to receive the two measurement values $V_{M_I}$ and $V_{M_V}$. Furthermore, the selector 1032 is configured to select the measurement value $V_{M_I}$ in the voltage supply mode, and to select the measurement value $V_{M_V}$ in the current supply mode. The A/D converter 1034 is configured to convert the measurement value selected by the selector 1032 into a digital value. The A/D converter 1034 functions as an ammeter in the voltage supply mode, and functions as a voltmeter in the current supply mode.

RELATED ART DOCUMENTS

Patent Documents

[Patent Document 1]
Japanese Patent Application Laid-Open No. H07-311223
[Patent Document 2]
Japanese Patent Application Laid Open No. 2001-41997

The detection resistor Rs is configured as a variable resistor, and is configured to be capable of switching its resistance according to the range of the power supply current $I_{DD}$.

Here, when the resistance of the detection resistor Rs is switched, this results in a sudden change in the voltage between both terminals of the detection resistor Rs. This leads to a problem in that spike noise (which is also referred to as a "glitch") is superimposed on the voltage $V_{DD}$ supplied to the DUT 1.

In particular, when the resistance of the detection resistor Rs is switched in the voltage supply mode in order to switch the current measurement range, the voltage $V_{DD}$ supplied to the DUT 1 enters the overvoltage state or the low-voltage state. In some cases, this leads to degradation of the reliability of the DUT 1, or leads to an abnormal operation of the DUT 1. Furthermore, after such a glitch occurs, there is a need to set a waiting time required to stabilize the voltage $V_{DD}$ to a setting value, which results in the test time becoming long.

In order to prevent such a glitch in the voltage supply mode, there is a need to employ an approach in which, before the current range is switched, the voltage supply by means of the power supply apparatus 1100 is temporarily suspended, and the resistance of the detection resistor Rs is switched, following which the voltage supply by means of the power supply apparatus 1100 is resumed. However, such an approach requires an on/off sequence control operation for the power supply apparatus 1100, which also results in the test time becoming long.

In the current supply mode, in principal, it is difficult to switch the resistance of the detection resistor Rs in the current supply operation because this leads to discontinuity in the feedback operation. Thus, when the setting value of the current $I_{DD}$ is switched in the current supply mode, there is a need to instruct the power supply apparatus 1100 to perform the on/off sequence control operation, which also results in the test time becoming long.

SUMMARY OF THE INVENTION

The present invention has been made in order to solve such a problem. Accordingly, it is an exemplary purpose of the present invention to provide a power supply apparatus which is capable of suppressing glitch noise when the resistance of a detection resistor is switched.

An embodiment of the present invention relates to a power supply apparatus configured to supply a stabilized power supply voltage to a power supply terminal of a device via a power supply line. The power supply apparatus comprises: a main reference value setting unit configured to generate a voltage reference value which represents a target level of the power supply voltage; a first A/D converter configured to receive, via a feedback line, an analog voltage measurement value that corresponds to the power supply voltage supplied to the power supply terminal of the device, and to analog/digital convert the analog voltage measurement value thus received so as to generate a digital voltage measurement value; a digital calculation unit configured to generate a main control value by digital calculation such that the digital voltage measurement value matches the voltage reference value; a main D/A converter configured to digital/analog convert the main control value, and to supply an analog power supply signal thus obtained as a result to the power supply terminal of the device via the power supply line; a main detection resistor arranged on a path of the power supply line, and configured to be capable of switching its resistance; a main sense amplifier configured to generate an analog main current measurement value which represents a current value of a power supply current that flows through the power supply line, based on a voltage across the main detection resistor; a second A/D converter configured to analog/digital convert the analog main current measurement value, so as to generate a digital main current measurement value; and an auxiliary current source configured to supply an auxiliary current to the power supply terminal of the device via a sub-path that differs from the power supply line when the resistance of the main detection resistor is switched.

With such an embodiment, when the resistance of the main detection resistor is switched, by supplying the current from the auxiliary current source in place of the hitherto supplied current that flows through the power supply line, such an arrangement allows the current that flows through the power supply line to be zero. With such an arrangement, the resistance is switched in a state in which the current that flows through the power supply line is zero, thereby suppressing glitches.

Also, the auxiliary current may be set to zero in a normal state. Also, when the resistance of the main detection resistor is switched, the power supply apparatus may execute: 1) acquiring a value of current that flows through the main detection resistor before the resistance of the main detection resistor is switched; 2) the auxiliary current source generating an auxiliary current that is equal to the current value thus acquired; 3) switching the resistance of the main detection resistor; and 4) the auxiliary current source reducing the auxiliary current to zero.

Also, the auxiliary current source may be configured to acquire the value of current that flows through the detection resistor with reference to the digital main current measurement value.

Also, the auxiliary current source may comprise: a sub-detection resistor arranged on the sub-path through which the auxiliary current flows; a sub-sense amplifier configured to generate an analog sub-current measurement value which represents the current value of the auxiliary current based on a voltage across the sub-detection resistor; a third A/D converter configured to analog/digital convert the analog sub-current measurement value so as to generate a digital sub-current measurement value; a current control unit configured to generate a sub-control value which represents a level of a voltage to be applied to one terminal of the sub-detection resistor; and a sub-D/A converter configured to digital/analog convert the sub-control value, and to apply a signal thus obtained as a result to the aforementioned one terminal of the sub-detection resistor.

Also, the current control unit may comprise: a sub-reference value setting unit configured to generate a sub-reference value which represents a reference value of the auxiliary current; and a sub-digital calculation unit configured to generate the sub-control value by digital calculation such that the digital sub-current measurement value matches the sub-reference value.

Also, when the resistance of the main detection resistor is switched, the power supply apparatus may be configured to execute: 1) the sub-reference value setting unit holding the digital main current measurement value; 2) the sub-reference value setting unit changing the sub-reference value from zero to the digital main current measurement value thus held; 3) switching the resistance of the main detection resistor; and 4) the sub-reference value setting unit changing the sub-reference value from the digital main current measurement value thus held to zero.

Also, the sub-path may be disconnected in a normal state. Also, before the auxiliary current source starts to generate the auxiliary current, the sub-path may be switched to a connection state in a state in which the current control unit outputs the sub-control value that is equal to the digital voltage measurement value.

Also, the sub-detection resistor may be configured as a variable resistor which is capable of switching its resistance. Also, when the resistance of the main detection resistor is switched, the resistance of the sub-detection resistor may be switched to a higher one of two resistance values between which the resistance value of the main detection resistor is switched.

Also, the main detection resistor and the sub-detection resistor may have the same circuit topology. Also, the main detection resistor may be configured to be capable of switching its resistance between M ("M" represents an integer) resistance values. Also, the sub-detection resistor may be configured to be capable of switching its resistance between (M−1) resistance values.

Another embodiment of the present invention relates to a power supply apparatus configured to supply a stabilized power supply current to a power supply terminal of a device via a power supply line. The power supply apparatus comprises: a main reference value setting unit configured to generate a current reference value which represents a reference value of the power supply current; a main detection resistor arranged on a path of the power supply line, and configured to be capable of switching its resistance; a main sense amplifier configured to generate an analog main current measurement value which represents the value of the power supply current that flows through the power supply line, based on a voltage across the main detection resistor; a second A/D converter configured to analog/digital convert the analog main current measurement value so as to generate a digital main current measurement value; a digital calculation unit configured to generate a main control value by digital calculation such that the digital main current measurement value matches the current reference value; a main D/A converter configured to digital/analog convert the main control value, and to supply an analog power supply signal thus obtained as a result to the power supply terminal of the device; a first A/D converter configured to receive, via a feedback line, an analog voltage measurement value that corresponds to the power supply voltage supplied to the power supply terminal of the device, and to analog/digital convert the analog voltage measurement value so as to generate a digital voltage measurement value; and an auxiliary current source configured to supply an auxiliary current to the power supply terminal of the device via a sub-path that differs from the power supply line when the resistance of the main detection resistor is switched.

With such an embodiment, when the resistance of the main detection resistor is switched, by supplying the current from the auxiliary current source in place of the hitherto supplied current that flows through the power supply line, such an arrangement allows the current that flows through the power supply line to be zero. With such an arrangement, the resistance is switched in a state in which the current that flows through the power supply line is zero, thereby suppressing glitches.

Also, the auxiliary current may be set to zero in a normal state. Also, when the resistance of the main detection resistor is switched, the power supply apparatus may execute: 1) the auxiliary current source increasing the value of the auxiliary current from zero to a normal state reference value of the power supply current, and the main reference value setting unit reducing the current reference value from the normal state value to zero, while maintaining the sum total of the power supply current and the auxiliary current at the normal state reference value of the power supply current; 2) switching the resistance of the main detection resistor; and 3) the auxiliary current source reducing the value of the auxiliary current from the normal state reference value of the power supply current to zero, and the main reference value setting unit increasing the current reference value from zero to the normal state value, while maintaining the sum total of the power supply current and the auxiliary current at the normal state reference value of the power supply current.

Also, the auxiliary current source may comprise: a sub-detection resistor arranged on the sub-path through which the auxiliary current flows; a sub-sense amplifier configured to generate an analog sub-current measurement value which represents the value of the auxiliary current based on a voltage across the sub-detection resistor; a third A/D converter configured to analog/digital convert the analog sub-current measurement value so as to generate a digital sub-current measurement value; a current control unit configured to generate a sub-control value which represents a level of a voltage to be applied to one terminal of the sub-detection resistor; and a sub-D/A converter configured to digital/analog convert the sub-control value, and to apply a signal thus obtained as a result to the aforementioned one terminal of the sub-detection resistor.

Also, the current control unit may comprise: a sub-reference value setting unit configured to generate a sub-reference value which represents a reference value of the auxiliary current; and a sub-digital calculation unit configured to generate the sub-control value by digital calculation such that the digital sub-current measurement value matches the sub-reference value.

Also, when the resistance of the main detection resistor is switched, the power supply apparatus may execute: 1) the sub-reference value setting unit increasing the sub-reference value from zero to the normal-state current reference value, and the main reference value setting unit reducing the current reference value from the normal-state value to zero, while maintaining the sum total of the current reference value and the sub-reference value at the normal-state current reference value; 2) switching the resistance of the main detection resistor; and 3) the sub-reference value setting unit reducing the sub-reference value from the normal-state current reference value to zero, and the main reference value setting unit increasing the current reference value from zero to the normal-state value, while maintaining the sum total of the current reference value and the sub-reference value at the normal-state current reference value.

Also, the sub-path may be disconnected in a normal state. Also, before the auxiliary current source starts to generate the auxiliary current, the sub-path may be switched to a connection state in a state in which the current control unit outputs the sub-control value that is equal to the digital voltage measurement value.

Also, the sub-detection resistor may be configured as a variable resistor which is capable of switching its resistance. Also, when the resistance of the main detection resistor is switched, the resistance of the sub-detection resistor may be switched to a higher one of two resistance values between which the resistance value of the main detection resistor is switched.

Also, the main detection resistor and the sub-detection resistor may have the same circuit topology. Also, the main detection resistor may be configured to be capable of switching its resistance between M (M represents an integer) resistance values. Also, the sub-detection resistor may be configured to be capable of switching its resistance between (M−1) resistance values.

Yet another embodiment of the present invention relates to a test apparatus. The test apparatus comprises the aforementioned power supply apparatus configured to supply electric power to a device under test.

Such an embodiment is capable of judging the quality of a device under test and detecting defective portions of the device under test while suppressing the occurrence of a glitch in the power supply voltage. Furthermore, with such an embodiment, there is no need to perform an on/off sequence control operation for the power supply apparatus every time the resistance is switched, thereby allowing the test time to be reduced.

It is to be noted that any arbitrary combination or rearrangement of the above-described structural components and so forth is effective as and encompassed by the present embodiments.

Moreover, this summary of the invention does not necessarily describe all necessary features so that the invention may also be a sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

In the present specification, the state represented by the phrase "the member A is connected to the member B" includes a state in which the member A is indirectly connected to the member B via another member that does not substantially affect the electric connection therebetween, or that does not damage the functions or effects of the connection therebetween, in addition to a state in which the member A is physically and directly connected to the member B.

Similarly, the state represented by the phrase "the member C is provided between the member A and the member B" includes a state in which the member A is indirectly connected to the member C, or the member B is indirectly connected to the member C via another member that does not substantially affect the electric connection therebetween, or that does not damage the functions or effects of the connection therebetween, in addition to a state in which the member A is directly connected to the member C, or the member B is directly connected to the member C.

Figure 1:
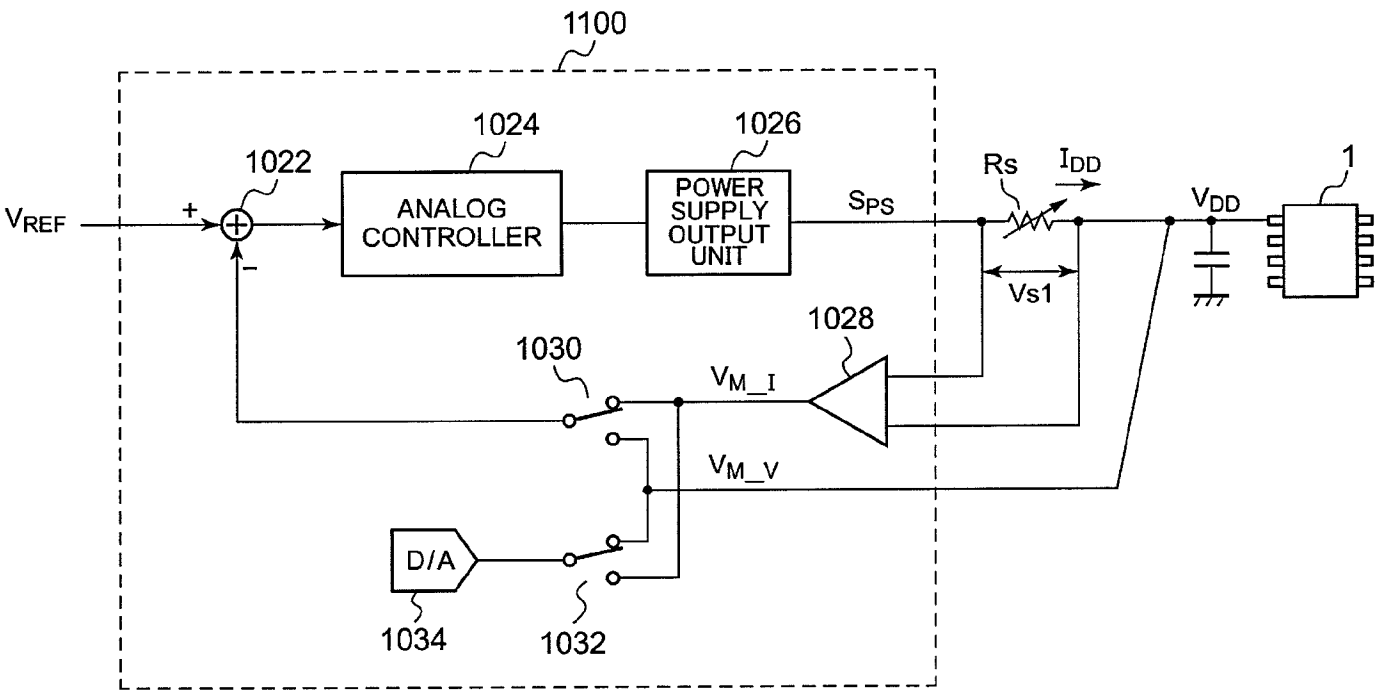
FIG. 1 is a block diagram showing a schematic configuration of a power supply apparatus investigated by the present inventors.
Figure 2:
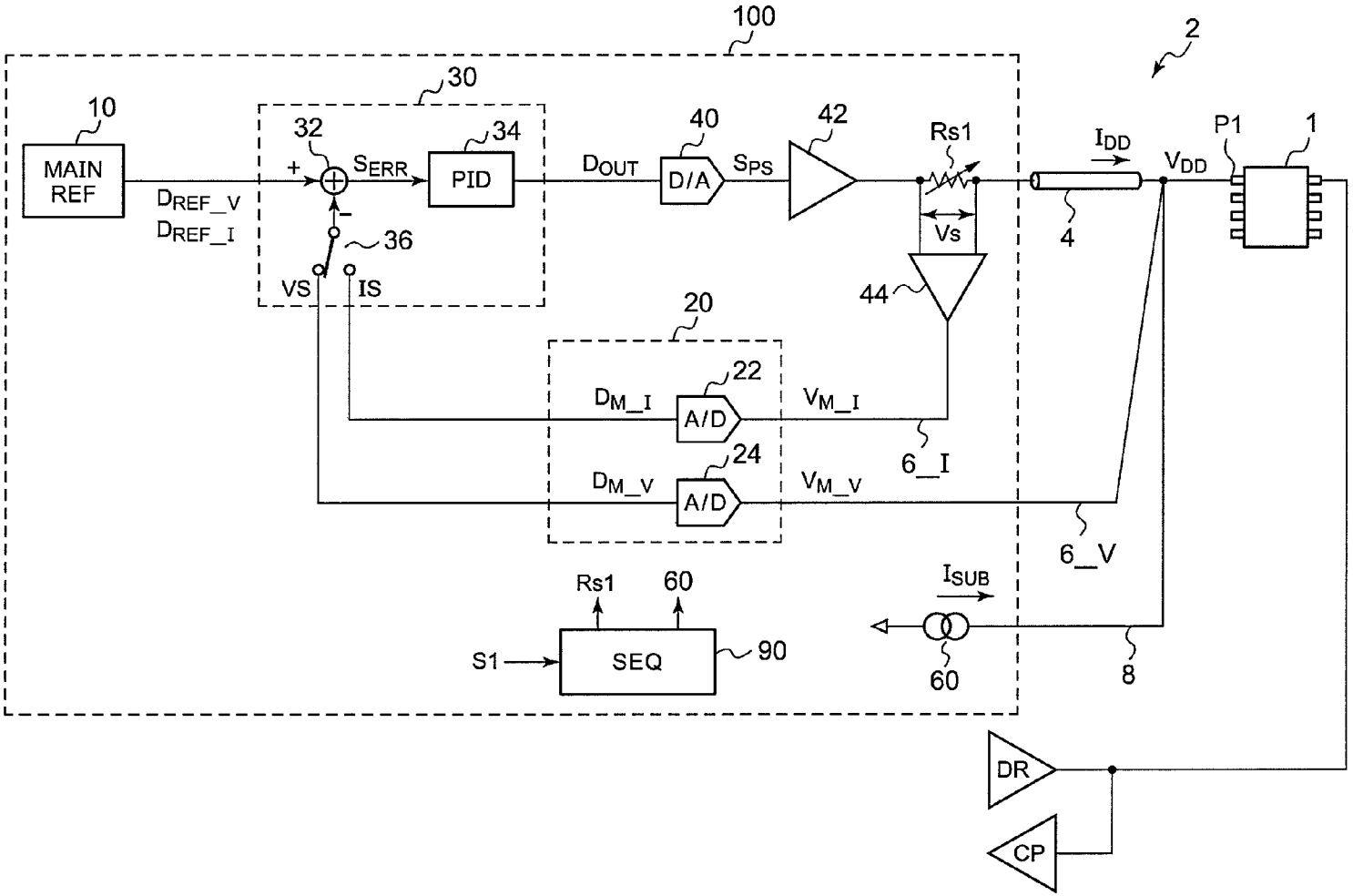
FIG. 2 is a block diagram showing a test apparatus including a power supply apparatus according to an embodiment.

FIG. 2 is a block diagram showing a test apparatus 2 including a power supply apparatus 100 according to an embodiment. The test apparatus 2 is configured to supply a signal to a DUT 1, to compare an output signal from the DUT 1 with an expected value, and to judge the quality or defective portions of the DUT 1.

The test apparatus 2 includes a driver DR, a comparator (timing comparator) CP, a power supply apparatus 100, and the like. The driver DR is configured to output a test pattern signal to the DUT 1. The test pattern signal is generated by means of a timing generator TG, a pattern generator PG, a waveform shaper FC (Format Controller), and the like, all of which are not shown, and is input to the driver DR. The signal output from the DUT 1 is input to the comparator CP. The comparator CP is configured to compare the signal output from the DUT 1 with a predetermined threshold value, and to latch the comparison result at an appropriate timing. The output of the comparator CP is compared with its expected value. The above is the schematic configuration of the test apparatus 2.

The power supply apparatus 100 is configured to generate a power supply signal $S_{PS}$ to be supplied to the DUT 1, and to supply the power supply signal $S_{PS}$ to a power supply terminal P1 of the DUT 1 via a power supply cable (power supply line) 4 or the like.

The power supply apparatus 100 according to the present embodiment is configured to be capable of switching its mode between a voltage supply (VS) mode in which the voltage value (which will also be referred to as the "power supply voltage") $V_{DD}$ of the power supply signal $S_{PS}$ supplied to the DUT 1 is maintained at a constant value, and a current supply (IS) mode in which the current value (which will also be referred to as the "power supply current") $I_{DD}$ of the power supply signal is maintained at a constant value.

The power supply apparatus 100 includes a main reference value setting unit 10, an A/D converter 20, a digital calculation unit 30, a main D/A converter 40, a main buffer amplifier 42, a main detection resistor Rs1, a main sense amplifier 44, an auxiliary current source 60, and a sequencer 90.

The sequencer 90 is configured to control the operation of each block of the power supply apparatus 100.

The A/D converter 20 is configured to receive, via a feedback line 6, an analog measurement value $V_M$ that corresponds to the power supply signal $S_{PS}$ supplied to the power supply terminal P1 of the DUT 1, and to analog/digital convert the analog measurement value $V_M$ so as to generate a digital measurement value $D_M$.

More specifically, the A/D converter 20 includes a second A/D converter 22 and a first A/D converter 24.

In the voltage supply mode, the first A/D converter 24 is configured to analog/digital convert the analog voltage measurement value $V_{M_V}$, which represents the power supply voltage $V_{DD}$ supplied to the DUT 1, so as to generate a digital voltage measurement value $D_{M_V}$. As the analog voltage measurement value $V_{M_V}$, the power supply voltage $V_{DD}$ supplied to the DUT 1 may itself be employed. Also, a dropped voltage obtained by dividing the power supply voltage $V_{DD}$ may be employed as the analog voltage measurement value $V_{M_V}$.

The main detection resistor Rs1, the main sense amplifier 44, and the second A/D converter 22 are arranged in order to detect the current value of the power supply current $I_{DD}$ in the current supply mode or otherwise the voltage supply mode.

The main detection resistor Rs1 is arranged on a path of the power supply line 4. A voltage drop Vs1 occurs between both terminals of the main detection resistor Rs1 in proportion to the power supply current $I_{DD}$. The main sense amplifier 44 is configured to amplify the voltage drop Vs1 across the main detection resistor Rs1, so as to generate an analog main current measurement value $V_{M_I}$. The main detection resistor Rs1 is configured as a variable resistor which is capable of switching its resistance value according to the current range of the power supply current $I_{DD}$.

The second A/D converter 22 is configured to analog/digital convert the analog main current measurement value $V_{M_I}$ which represents the power supply current $I_{DD}$ supplied to the DUT 1, so as to generate a digital main current measurement value $D_{M_I}$.

The main reference value setting unit 10 is configured to generate a main reference value $D_{REF}$ which represents a reference value of the power supply signal $S_{PS}$. More specifically, the main reference value setting unit 10 is configured to generate a voltage reference value $D_{REF_V}$ which represents a target level of the power supply voltage $V_{DD}$ in the voltage supply mode, and to generate a current reference value $D_{REF_I}$ which represents a reference value of the power supply current $I_{DD}$ in the current supply mode.

The digital calculation unit 30 is configured to generate a digital main control value $D_{OUT}$ by means of digital calculation. The main control value $D_{OUT}$ is adjusted such that the digital measurement value $D_M$ output from the A/D converter 20 matches the reference value $D_{REF}$ received from the main reference value setting unit 10. For example, the digital calculation unit 30 may be configured as a CPU (Central Processing Unit), a DSP (Digital Signal Processor), an FPGA (Field Programmable Gate Array), or the like.

The digital calculation unit 30 may be configured to perform a PID (proportional-integral-differential) control operation based on the difference (error) between the digital measurement value $D_M$ and the reference value $D_{REF}$. The digital calculation unit 30 may perform any one of a P control operation, a PI control operation, or a PD control operation.

More specifically, the digital calculation unit 30 includes a subtractor 32, a controller 34, and a selector 36.

The selector 36 is configured to select the digital voltage measurement value $D_{M_V}$ in the voltage supply mode, and to select the digital current measurement value $D_{M_I}$ in the current supply mode.

The subtractor 32 is configured to generate an error signal $S_{ERR}$ which represents the difference between the digital measurement value $D_M$ selected by the selector 36 and the reference value $D_{REF}$. The controller 34 is configured to generate the main control value $D_{OUT}$ based on the error signal $S_{ERR}$ by means of any one of (1) a proportional (P) control operation, (2) a proportional-integral (PI) control operation, or (3) a proportional-integral-differential (PID) control operation.

The main D/A converter 40 is configured to digital/analog convert the main control value $D_{OUT}$ so as to generate an analog voltage $V_{OUT}$. The analog voltage $V_{OUT}$ thus obtained is supplied as the power supply signal $S_{PS}$ to the power supply terminal P1 of the device 1 under test via the power supply line 4. As a downstream component of the main D/A converter 40, the main buffer amplifier 42 having a low output impedance is arranged.

The auxiliary current source 60 is configured to supply an auxiliary current $I_{SUB}$ to the power supply terminal of the DUT 1 via a sub-path 8 that differs from the power supply line 4.

The above is the basic configuration of the power supply apparatus 100. Next, description will be made regarding the operation thereof.

When the resistance of the main detection resistor Rs1 is switched, the operation of the power supply apparatus 100 differs between the voltage supply mode and the current supply mode. Description will be made below regarding the operations in the respective modes.

(1) Voltage Supply Mode

Figure 3:
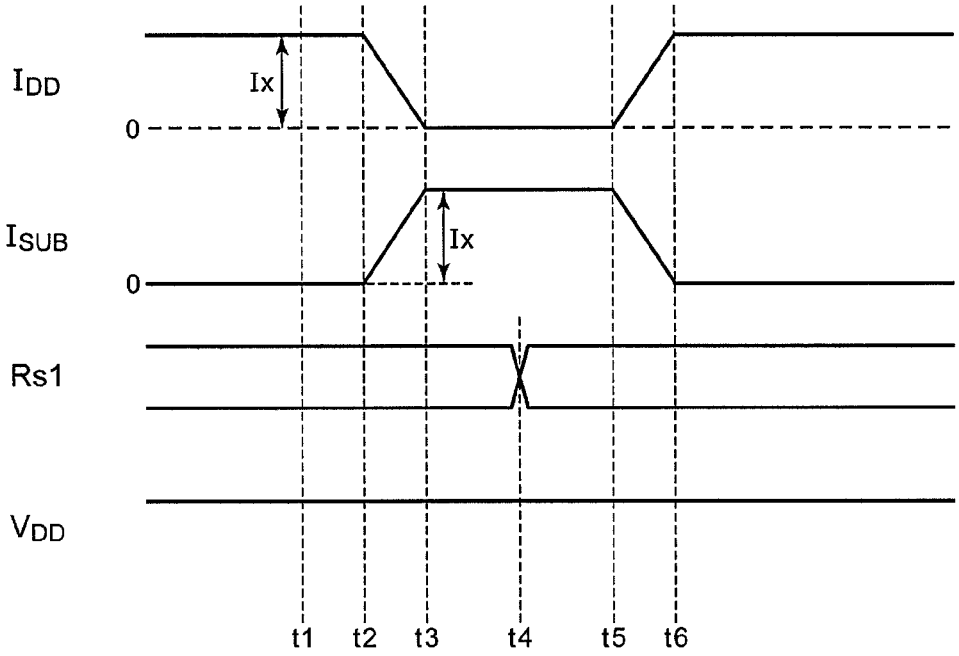
FIG. 3 is a waveform diagram showing the operation of the power supply apparatus in the voltage supply mode.

FIG. 3 is a waveform diagram showing an operation of the power supply apparatus 100 in the voltage supply mode.

In a normal state, the power supply voltage $V_{DD}$ is stabilized to a level that corresponds to the voltage reference value $D_{REF_V}$. In this state, a certain amount of the power supply current $I_{DD}$ flows through the power supply line 4, and the auxiliary current $I_{SUB}$ to be generated by the auxiliary current source 60 is zero.

Before the switching of the resistance of the main detection resistor Rs1, the current $I_{DD}$ that flows through the power supply line 4 is measured at the time t1. As described above, the digital main current measurement value $D_{M_I}$ generated by the second A/D converter 22 represents the current value Ix of the power supply current $I_{DD}$.

Subsequently, at the time t2, the auxiliary current source 60 starts to generate the auxiliary current $I_{SUB}$ such that it reaches the current value Ix which has been measured at the time t1. The auxiliary current $I_{SUB}$ is raised at a finite slope such that it reaches the current value Ix at the time t3.

During this step, the power supply voltage $V_{DD}$ is stabilized such that it matches the target voltage level by means of a feedback control operation provided via a loop comprising the digital calculation unit 30, the main D/A converter 40, the main buffer amplifier 42, the power supply line 4, the feedback line 6_V, and the first A/D converter 24. In this step, if the impedance $Z_{DUT}$ of the DUT 1 that functions as a load is maintained at a constant value, the power supply current $I_{DD}$ that flows through the power supply line 4 automatically drops to zero according to an increase in the sub-current $I_{SUB}$.

At the time t4 after the auxiliary current $I_{SUB}$ stabilizes, and the current that flows through the main detection resistor Rs1 becomes zero, the resistance of the main detection resistor Rs1 is switched.

Subsequently, at the time t5 after the completion of the switching of the resistance of the main detection resistor Rs1, the auxiliary current source 60 starts to return the auxiliary current $I_{SUB}$ to zero. Subsequently, the auxiliary current $I_{SUB}$ becomes zero at the time t6, and thus the state returns to the normal state.

As described above, when the resistance of the main detection resistor Rs1 is switched, the current is supplied from the auxiliary current source 60 in place of the hitherto supplied current that flows through the power supply line 4. This allows the current $I_{DD}$ that flows through the power supply line 4 to be set to zero. With such an arrangement, the resistance of the main detection resistor Rs1 is switched in a state in which the current that flows through the power supply line 4 is zero, thereby suppressing glitches.

Furthermore, such an arrangement does not require the on/off sequence control operation for the power supply apparatus every time the detection resistor is switched. Thus, such an arrangement allows the test time to be reduced.

(2) Current Supply Mode

Description will be made with reference to FIG. 3 regarding the operation of the power supply apparatus 100 in the current supply mode.

In the normal state, the power supply current $I_{DD}$ that flows through the power supply line 4 is stabilized to the current value Ix that corresponds to the current reference value $D_{REF_I}$. In this state, the auxiliary current $I_{SUB}$ to be generated by the auxiliary current source 60 is zero.

Between the time points t2 and t3, the auxiliary current source 60 raises the current value of the auxiliary current $I_{SUB}$ from zero to the reference value Ix, which matches the value of the power supply current $I_{DD}$ in the normal state, while maintaining the sum total of the power supply current $I_{DD}$ and the auxiliary current $I_{SUB}$ at the reference value Ix, which is the value of the power supply current $I_{DD}$ in the normal state.

During this step, the main reference value setting unit 10 reduces the current reference value $D_{REF_I}$ from the normal state value to zero. The power supply current $I_{DD}$ is reduced from the normal state reference value Ix to zero by means of the feedback control operation of the digital calculation unit 30.

At the time t4 after the auxiliary current $I_{SUB}$ is stabilized, and the current that flows through the main detection resistor Rs1 becomes zero, the resistance of the main detection resistor Rs1 is switched.

Subsequently, between the time points t5 through t6 after the completion of the switching of the resistance of the main detection resistor Rs1, the auxiliary current source 60 reduces the current value of the auxiliary current $I_{SUB}$ from the reference value Ix, which is a reference value of the power supply current $I_{DD}$ in the normal state, to zero, while maintaining the sum total of the power supply current $I_{DD}$ and the auxiliary current $I_{SUB}$ at the reference value Ix, which is a reference value of the power supply current $I_{DD}$ in the normal state. In this step, the main reference value setting unit 10 raises the current reference value $D_{REF_I}$ from zero to the normal state value. Thus, the power supply current $I_{DD}$ rises from zero to the normal state reference value Ix by means of the feedback control operation of the digital calculation unit 30.

As described above, when the resistance of the main detection resistor Rs1 is switched in the current supply mode, the auxiliary current source 60 also supplies a current, in place of the hitherto supplied current that flows through the power supply line 4. Such an arrangement allows the current $I_{DD}$ that flows through the power supply line 4 to be zero. Thus, by switching the resistance of the main detection resistor Rs1 in a state in which the current that flows through the power supply line 4 is zero, such an arrangement suppresses glitches.

Furthermore, such an arrangement does not require the on/off sequence control operation for the power supply apparatus every time the detection resistor is switched. Thus, such an arrangement allows the test time to be reduced.

Next, description will be made regarding a specific example configuration of the auxiliary current source 60.

Figure 4:
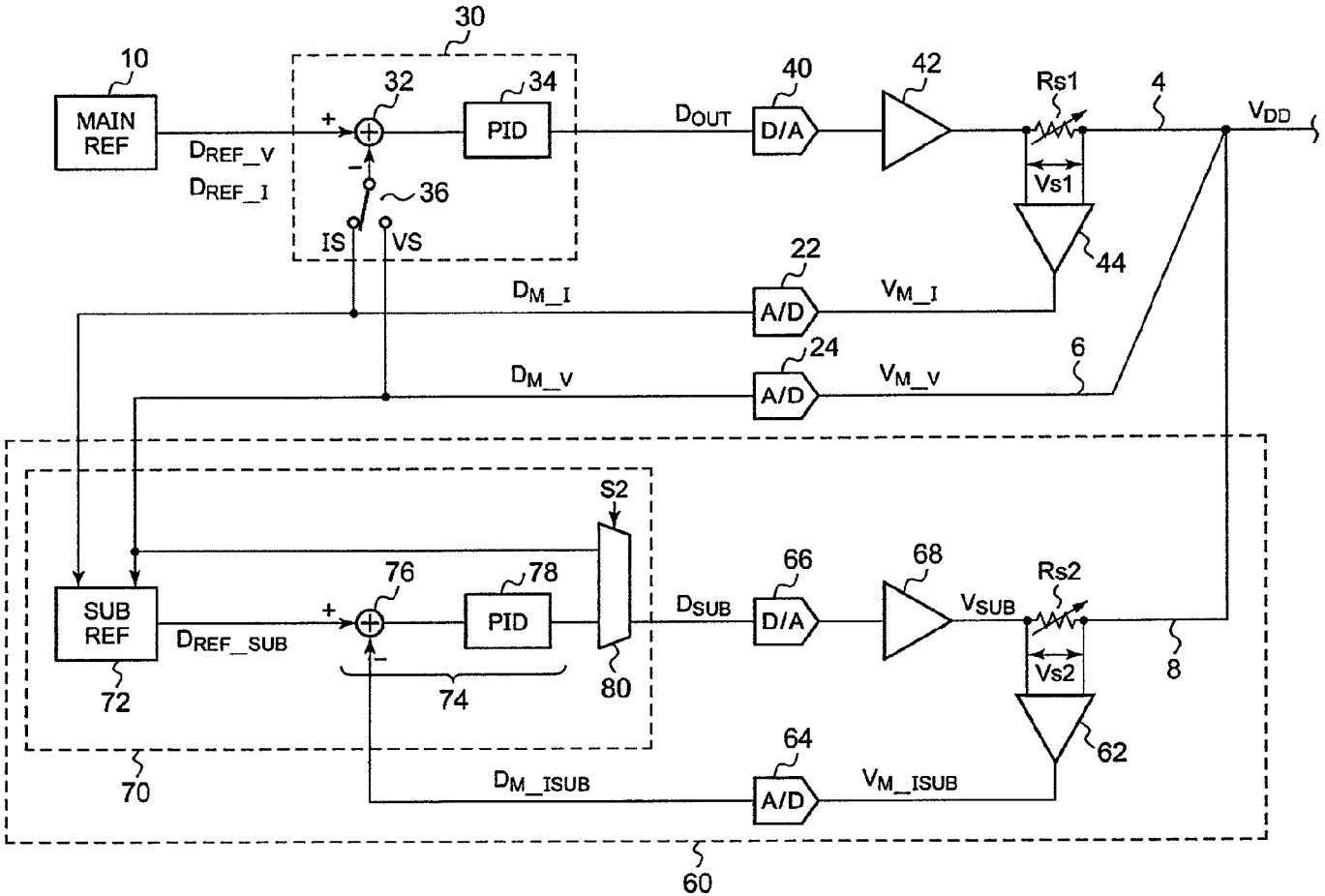
FIG. 4 is a circuit diagram showing an example configuration of an auxiliary current source.

FIG. 4 is a circuit diagram showing an example configuration of the auxiliary current source 60.

The auxiliary current source 60 has the same configuration as that of the main feedback loop comprising the digital calculation unit 30, the main D/A converter 40, the main buffer amplifier 42, the main sense amplifier 44, and the second A/D converter 22. Specifically, the auxiliary current source 60 includes a sub-detection resistor Rs2, a sub-sense amplifier 62, a third A/D converter 64, a sub-D/A converter 66, a sub-buffer amplifier 68, and a current control unit 70.

The sub-detection resistor Rs2 is arranged on the sub-path 8. A voltage drop Vs2 occurs between both terminals of the sub-detection resistor Rs2 in proportion to the auxiliary current $I_{SUB}$. The sub-reference value setting unit 72 amplifies the voltage drop Vs2 that occurs at the sub-detection resistor Rs2, so as to generate an analog sub-current measurement value $V_{M_ISUM}$ which represents the current value of the auxiliary current I. The sub-detection resistor Rs2 is configured as a variable resistor which is capable of switching its resistance value, in the same manner as the main detection resistor Rs1.

In order to adjust the power supply voltage $V_{DD}$ or otherwise the power supply current $I_{DD}$ such that it approaches the reference value with high precision, such an arrangement requires the main D/A converter 40 to have a high resolution. In contrast, the auxiliary current $I_{SUB}$ is generated in order to reduce glitches. That is to say, the auxiliary current $I_{SUB}$ does not directly have an effect on the operation of the DUT 1. Thus, such an arrangement does not require the auxiliary current $I_{SUB}$ to be generated with high precision as compared with the power supply voltage $V_{DD}$ or the power supply current $I_{DD}$. Thus, the sub-D/A converter 66 may be configured to have a lower resolution than that of the main D/A converter 40. Specifically, the sub-D/A converter 66 may be configured to have a resolution on the order of 1/10 of that of the main D/A converter 40. Such an arrangement allows the sub-D/A converter to be configured to have a small circuit area. Thus, such a sub-D/A converter 66 does not have a large impact on the overall circuit area.

The third A/D converter 64 is configured to analog/digital convert the analog sub-current measurement value $V_{M_ISUB}$, so as to generate a digital sub-current measurement value $V_{M_ISUB}$. The current control unit 70 is configured to generate a sub-control value $D_{SUB}$ which represents the level of the voltage $V_{SUB}$ to be applied to one terminal of the sub-detection resistor Rs2. The sub-D/A converter 66 is configured to digital/analog convert the sub-control value $D_{SUB}$. The signal $V_{SUB}$ thus obtained as a result is applied to the aforementioned one terminal of the sub-detection resistor Rs2. As a downstream component of the sub-D/A converter 66, the sub-buffer amplifier 68 having a low output impedance is arranged.

The current control unit 70 includes the sub-reference value setting unit 72, a sub-digital calculation unit 74, and the selector 80.

The sub-reference value setting unit 72 is configured to generate a sub-reference value $D_{REF_SUB}$ which represents a reference value of the auxiliary current $I_{SUB}$. The sub-digital calculation unit 74 is configured to generate a sub-control value $D_{SUB}$ by means of digital calculation such that a digital sub-current measurement value $D_{M_ISUM}$ matches the sub-reference value $D_{REF_SUB}$. The sub-digital calculation unit 74 includes a subtractor 76 and a controller 78, and has the same configuration as that of the digital calculation unit 30. The coefficients and the parameters of the controller 78 may be set to the same values as those of the controller 34. Also, the coefficients and the parameters of the controller 78 may be optimized independently of those of the controller 34. The selector 80 is configured to receive the output of the sub-digital calculation unit 74 and the digital voltage measurement value $D_{M_V}$ output from the first A/D converter 24, and to select one of them. Specifically, in a period in which a tracking control signal S2 is asserted as described later, the selector selects the digital voltage measurement value $D_{M_V}$.

Figure 5:
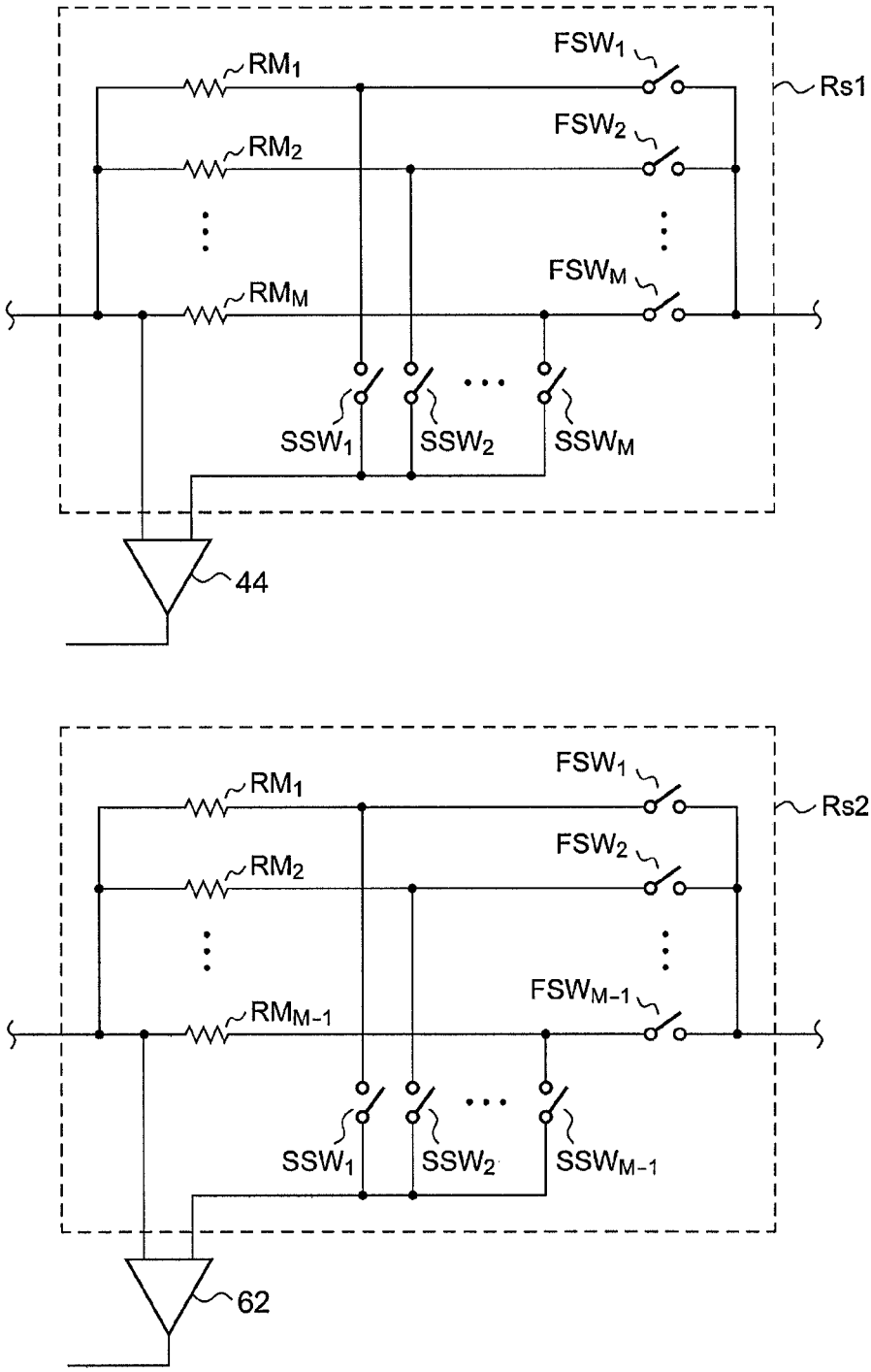
FIG. 5 is a circuit diagram showing an example configuration of a main detection resistor and a sub-detection resistor.

FIG. 5 is a circuit diagram showing an example configuration of the main detection resistor Rs1 and the sub-detection resistor Rs2.

The main detection resistor Rs1 is configured to allow its resistance to be selectively switched from among M resistance values. The main detection resistor Rs1 includes resistors $RM_1$ through $RM_M$, switches $FSW_1$ through $FSW_M$, and switches $SSW_1$ through $SSW_M$. The sub-detection resistor Rs2 has the same circuit topology as that of the main detection resistor Rs1.

With the present embodiment, when the resistance value of the main detection resistor Rs1 is switched, the resistance value of the sub-detection resistor Rs2 is switched to the higher of the two resistance values between which the resistance value of the main detection resistor Rs1 is switched. Accordingly, the lowest resistance value of the main detection resistor Rs1 is removed from the possible resistance values of the sub-detection resistor Rs2. Thus, the number of resistance values of the sub-detection resistor Rs2 that can be selectively switched is (M−1). Thus, such an arrangement does not require the resistor $RM_M$, the switches $FSW_M$, and $SSW_M$, thereby allowing the circuit area to be reduced.

The above is an example configuration of the auxiliary current source 60. Next, description will be made regarding the operation of the auxiliary current source 60 shown in FIG. 4.

The sub-path 8 including the auxiliary current source 60 is configured to be capable of switching its state between a connection state and a disconnection state. Specifically, when the switches $FSW_1$ through $FSW_{M-1}$ of the sub-detection resistor Rs are all turned off, the sub-path 8 is set to the disconnection state. When at least one of the switches $FSW_1$ through $FSW_{M-1}$ of the sub-detection resistor Rs2 is turned on, the sub-path 8 is set to the connection state. In the normal state, the sub-path 8 is set to the disconnection state.

Figure 6:
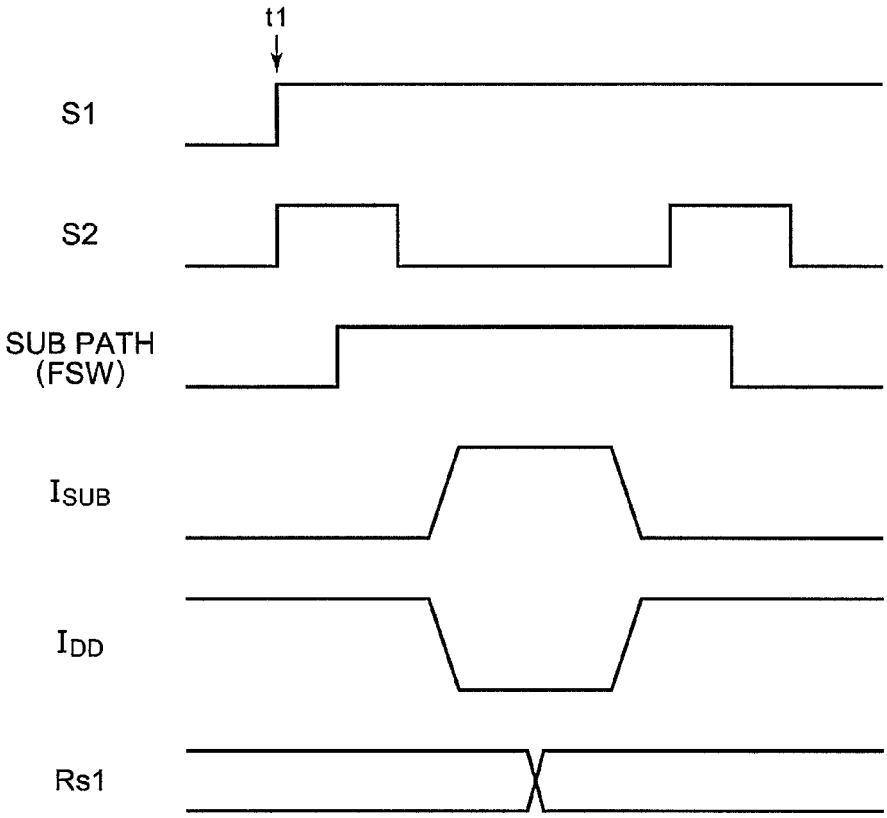
FIG. 6 is a time chart showing the switching of the auxiliary current source between the disconnection state and the connection state.

FIG. 6 is a time chart showing the switching of the auxiliary current source 60 between the disconnection state and the connection state. At the time t1, a signal S1 is asserted (set to high level), which is an instruction to switch the resistance value of the main detection resistor Rs1.

Upon receiving the signal S1 thus asserted, the sequencer 90 asserts a tracking control signal S2 before the auxiliary current source 60 starts to generate the auxiliary current $I_{SUB}$. During a period in which the tracking control signal S2 is asserted, the current control unit 70 outputs a sub-control value $D_{SUB}$ which is equal to the digital voltage measurement value $D_{M_V}$. This operation will be referred to as the "tracking control operation". By means of the tracking control operation, the voltage $V_{SUB}$ applied to one terminal of the sub-detection resistor Rs2 becomes equal to the voltage $V_{DD}$ at the other terminal of the sub-detection resistor Rs2.

In this state, the sub-path 8 (SUB PATH in FIG. 6) is switched from the disconnection state to the connection state. Specifically, from among the multiple switches $FSW_1$ through $FSW_{M-1}$ included in the sub-detection resistor Rs2, one switch that corresponds to the resistance value to be selected is selectively turned on. In this state, the voltage difference between both terminals of the sub-detection resistor Rs2 is zero. Thus, such an arrangement is capable of switching the sub-path 8 to the connection state while suppressing transitional fluctuation in the voltage and transitional fluctuation in the current.

When the sub-path 8 enters the connection state, the tracking control signal S2 is negated (set to low level). Subsequently, according to the sequence shown in FIG. 3, the auxiliary current $I_{SUB}$ and the power supply current $I_{DD}$ are changed, and the resistance value of the main detection resistor Rs1 is switched.

Next, the sequencer 90 again asserts the tracking control signal S2 so as to perform the tracking control operation. As a result, the voltage at one terminal of the sub-detection resistor R2 becomes equal to the voltage at the other terminal thereof. In this state, the sub-path 8 (SUB PATH in FIG. 6) is switched from the connection state to the disconnection state. Specifically, the multiple switches $FSW_1$ through $FSW_{M-1}$ included in the sub-detection resistor Rs2 are all turned off. In this state, the voltage difference between both terminals of the sub-detection resistor Rs2 is zero. Thus, such an arrangement is capable of switching the sub-path 8 to the disconnection state while suppressing transitional fluctuation in the voltage and transitional fluctuation in the current.

It should be noted that, at a timing when the sub-path 8 is switched from the connection state to the disconnection state, the auxiliary current $I_{SUB}$ is zero. Accordingly, in this stage, there is no need to perform the tracking control operation to maintain the voltage difference between both terminals of the sub-detection resistor Rs2 at zero. Thus, the tracking control operation can be omitted after the resistance value is switched.

Next, description will be made regarding the operation of the auxiliary current source 60 shown in FIG. 4 in each of the voltage supply mode and the current supply mode.

(1) Voltage Supply Mode

The auxiliary current source 60 executes the following processing when the resistance value of the main detection resistor Rs1 is switched.

1. The sub-reference value setting unit 72 holds the digital main current measurement value $D_{M_I}$.

In this step, the sub-reference value setting unit 72 may be configured to perform sampling of the digital main current measurement value $D_{M_I}$ multiple times, to calculate the average value of the multiple digital main current measurement values $D_{M_I}$ thus sampled, and to hold the average value thus calculated.

2. The sub-reference value setting unit 72 changes the sub-reference value $D_{REF_SUB}$ from zero to the digital main current measurement value $D_{M_I}$ thus held. This increases the auxiliary current $I_{SUB}$ from zero to the current Ix.

3. The resistance value of the main detection resistor is switched.

4. The sub-reference value setting unit 72 changes the sub-reference value $D_{REF_SUB}$ from the digital main current measurement value $D_{M_I}$ thus held to zero. This reduces the auxiliary current $I_{SUB}$ from the current Ix to zero.

(2) Current Supply Mode

The auxiliary current source 60 executes the following processing when the resistance value of the main detection resistor Rs1 is switched. The current reference value $D_{REF_I}$ for the normal state will be represented by $D_{REF_NORM}$.

1. The sub-reference value setting unit 72 increases the sub-reference value $D_{REF_SUB}$ from zero to the normal state value $D_{REF_NORM}$.

In this step, the main reference value setting unit 10 reduces the current reference value $D_{REF_I}$ from its normal state value $D_{REF_NORM}$ to zero, while maintaining the relation represented by the following relation Expression (1).

$$D_{REF_I}=D_{REF_NORM}-D_{REF_SUB} \quad (1)$$

2. The resistance value of the main detection resistor Rs1 is switched.

3. The sub-reference value setting unit 72 reduces the sub-reference value $D_{REF_SUB}$ from the value $D_{REF_NORM}$ to zero. In this step, the main reference value setting unit 10 increases the current reference value $D_{REF_I}$ from zero to its normal state value $D_{REF_NORM}$, while maintaining the relation represented by relation Expression (1).

The above is the operation of the auxiliary current source 60 shown in FIG. 4. With the auxiliary current source 60 shown in FIG. 4, such an arrangement allows the auxiliary current source 60 to operate appropriately in both the voltage supply mode and the current supply mode.

Description has been made regarding the present invention with reference to the embodiments. The above-described embodiments have been described for exemplary purposes only, and are by no means intended to be interpreted restrictively. Rather, various modifications may be made by making various combinations of the aforementioned components or processes. Description will be made below regarding such modifications.

[First Modification]

When the auxiliary current source 60 changes the current value of the auxiliary current $I_{SUB}$ in the voltage supply mode or the current supply mode, the sub-reference value setting unit 72 may gradually switch the sub-reference value $D_{REF_SUB}$. Such an arrangement reduces the effect of the auxiliary current source 60 on the main control loop.

Alternatively, in a case in which the sub-control loop including the sub-digital calculation unit 74 has a response speed that is to a certain extent slow, the sub-reference value setting unit 72 may instantly switch the sub-reference value $D_{REF_SUB}$. In this case, the auxiliary current $I_{SUB}$ gradually changes due to the delay in the response of the feedback loop.

[Second Modification]

Description has been made in the embodiment regarding an arrangement in which the tracking control operation is performed only in a predetermined period before and after the generation of the auxiliary current $I_{SUB}$. However, the present invention is not restricted to such an arrangement. For example, an arrangement may be made configured to perform the tracking control operation during a period that includes its normal period, and to disable the tracking control operation only in a period in which the sub-current $I_{SUB}$ is generated.

Third Embodiment

Figure 7:
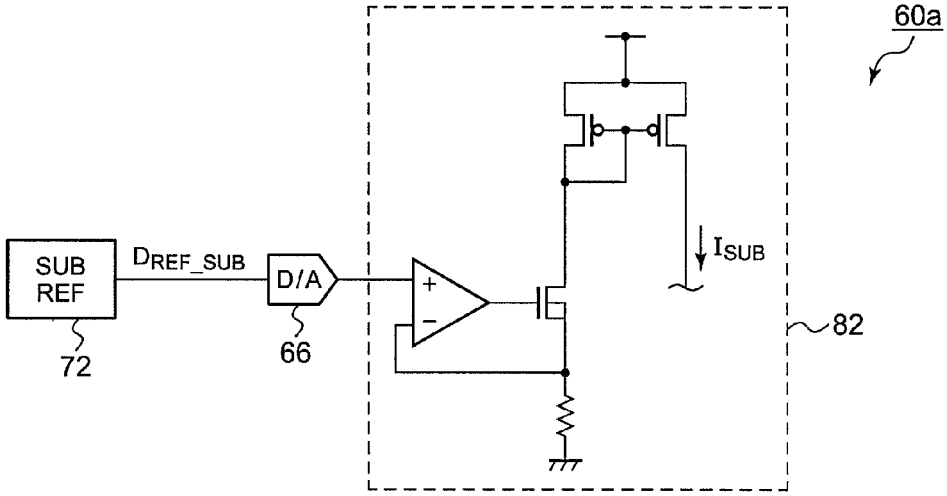
FIG. 7 is a circuit diagram showing an auxiliary current source according to a modification.

Description has been made in the embodiment regarding an arrangement in which the auxiliary current source 60 has the same configuration as that of the main power supply including the main reference value setting unit 10, the digital calculation unit 30, the main D/A converter 40, the main buffer amplifier 42, the main sense amplifier 44, and the second A/D converter 22. However, the present invention is not restricted to such an arrangement. FIG. 7 is a circuit diagram showing an auxiliary current source 60*a* according to a modification. The auxiliary current source 60*a* shown in FIG. 7 includes a V/I conversion circuit 82, in addition to the sub-reference value setting unit 72 and the sub-D/A converter 66. The V/I conversion circuit 82 is configured to generate an auxiliary current $I_{SUB}$ that is proportional to the sub-reference value $D_{REF_SUB}$. Various modifications may be made with respect to the V/I conversion circuit 82, which can be easily understood by those skilled in this art.

[Fourth Modification]

Description has been made in the embodiment regarding the power supply apparatus 100 which is capable of switching its mode between the voltage supply mode and the current supply mode. Also, the present invention is applicable to a power supply apparatus configured to operate in the voltage supply mode alone or in the current supply mode alone.

[Fifth Modification]

Also, a single A/D converter may function as the second A/D converter 22 and the third A/D converter 64 in a time sharing manner. Such an arrangement suppresses an increase in the circuit area.

While the preferred embodiments of the present invention have been described using specific terms, such description is for illustrative purposes only, and it is to be understood that changes and variations may be made without departing from the spirit or scope of the appended claims.

What is claimed is:

1. A power supply apparatus configured to supply a stabilized power supply voltage to a power supply terminal of a device via a power supply line, the power supply apparatus comprising:

a main reference value setting unit configured to generate a voltage reference value which represents a target level of the power supply voltage;

a first A/D converter configured to receive, via a feedback line, an analog voltage measurement value that corresponds to the power supply voltage supplied to the power supply terminal of the device, and to analog/digital convert the analog voltage measurement value thus received so as to generate a digital voltage measurement value;

a digital calculation unit configured to generate a main control value by digital calculation such that the digital voltage measurement value matches the voltage reference value;

a main D/A converter configured to digital/analog convert the main control value, and to supply an analog power supply signal thus obtained as a result to the power supply terminal of the device via the power supply line;

a main detection resistor arranged on a path of the power supply line, and configured to be capable of switching its resistance;

a main sense amplifier configured to generate an analog main current measurement value which represents a current value of a power supply current that flows through the power supply line based on a voltage across the main detection resistor;

a second A/D converter configured to analog/digital convert the analog main current measurement value, so as to generate a digital main current measurement value; and an auxiliary current source configured to supply an auxiliary current to the power supply terminal of the device via a sub-path that differs from the power supply line when the resistance of the main detection resistor is switched.

2. The power supply apparatus according to claim 1, wherein the auxiliary current is set to zero in a normal state, and wherein, when the resistance of the main detection resistor is switched, the power supply apparatus executes:

acquiring a value of current that flows through the main detection resistor before the resistance of the main detection resistor is switched;

the auxiliary current source generating an auxiliary current that is equal to the current value thus acquired;

switching the resistance of the main detection resistor; and the auxiliary current source reducing the auxiliary current to zero.

3. The power supply apparatus according to claim 2, wherein the auxiliary current source is configured to acquire the value of current that flows through the detection resistor with reference to the digital main current measurement value.

4. The power supply apparatus according to claim 1, wherein the auxiliary current source comprises:

a sub-detection resistor arranged on the sub-path;

a sub-sense amplifier configured to generate an analog sub-current measurement value which represents the current value of the auxiliary current based on a voltage across the sub-detection resistor;

a third A/D converter configured to analog/digital convert the analog sub-current measurement value so as to generate a digital sub-current measurement value;

a current control unit configured to generate a sub-control value which represents a level of a voltage to be applied to one terminal of the sub-detection resistor; and a sub-D/A converter configured to digital/analog convert the sub-control value, and to apply a signal thus obtained as a result to the aforementioned one terminal of the sub-detection resistor.

5. The power supply apparatus according to claim 4, wherein the current control unit comprises:

a sub-reference value setting unit configured to generate a sub-reference value which represents a reference value of the auxiliary current; and a sub-digital calculation unit configured to generate the sub-control value by digital calculation such that the digital sub-current measurement value matches the sub-reference value.

6. The power supply apparatus according to claim 5, wherein, when the resistance of the main detection resistor is switched, the power supply apparatus is configured to execute:

the sub-reference value setting unit holding the digital main current measurement value;

the sub-reference value setting unit changing the sub-reference value from zero to the digital main current measurement value thus held;

switching the resistance of the main detection resistor; and the sub-reference value setting unit changing the sub-reference value from the digital main current measurement value thus held to zero.

7. The power supply apparatus according to claim 6, wherein the sub-path is disconnected in a normal state, and wherein, before the auxiliary current source starts to generate the auxiliary current, the sub-path is switched to a connection state in a state in which the current control unit outputs the sub-control value that is equal to the digital voltage measurement value.

8. The power supply apparatus according to claim 4, wherein the sub-detection resistor is configured as a variable resistor which is capable of switching its resistance, and wherein, when the resistance of the main detection resistor is switched, the resistance of the sub-detection resistor is switched to a higher one of two resistance values between which the resistance value of the main detection resistor is switched.

9. The power supply apparatus according to claim 8, wherein the main detection resistor and the sub-detection resistor have the same circuit topology, and wherein the main detection resistor is configured to be capable of switching its resistance between M resistance values, and wherein the sub-detection resistor is configured to be capable of switching its resistance between (M−1) resistance values.

10. The test apparatus comprising the power supply apparatus according to claim 1, configured to supply electric power to a device under test.

11. A power supply apparatus configured to supply a stabilized power supply current to a power supply terminal of a device via a power supply line, the power supply apparatus comprising:

a main reference value setting unit configured to generate a current reference value which represents a reference value of the power supply current;

a main detection resistor arranged on a path of the power supply line, and configured to be capable of switching its resistance;

a main sense amplifier configured to generate an analog main current measurement value which represents the value of the power supply current that flows through the power supply line, based on a voltage across the main detection resistor;

a second A/D converter configured to analog/digital convert the analog main current measurement value so as to generate a digital main current measurement value;

a digital calculation unit configured to generate a main control value by digital calculation such that the digital main current measurement value matches the current reference value;

a main D/A converter configured to digital/analog convert the main control value, and to supply an analog power supply signal thus obtained as a result to the power supply terminal of the device;

a first A/D converter configured to receive, via a feedback line, an analog voltage measurement value that corresponds to the power supply voltage supplied to the power supply terminal of the device, and to analog/digital convert of the analog voltage measurement value so as to generate a digital voltage measurement value; and an auxiliary current source configured to supply an auxiliary current to the power supply terminal of the device via a sub-path that differs from the power supply line when the resistance of the main detection resistor is switched.

12. The power supply apparatus according to claim 11, wherein the auxiliary current is set to zero in a normal state, and wherein, when the resistance of the main detection resistor is switched, the power supply apparatus executes:

the auxiliary current source increasing the value of the auxiliary current from zero to a normal state reference value of the power supply current, and the main reference value setting unit reducing the current reference value from the normal state value to zero, while maintaining the sum total of the power supply current and the auxiliary current at the normal state reference value of the power supply current;

switching the resistance of the main detection resistor; and the auxiliary current source reducing the value of the auxiliary current from the normal state reference value of the power supply current to zero, and the main reference value setting unit increasing the current reference value from zero to the normal state value, while maintaining the sum total of the power supply current and the auxiliary current at the normal state reference value of the power supply current.

13. The power supply apparatus according to claim 11, wherein the auxiliary current source comprises:

a sub-detection resistor arranged on the sub-path;

a sub-sense amplifier configured to generate an analog sub-current measurement value which represents the value of the auxiliary current based on a voltage across the sub-detection resistor;

a third A/D converter configured to analog/digital convert the analog sub-current measurement value so as to generate a digital sub-current measurement value;

a current control unit configured to generate a sub-control value which represents a level of a voltage to be applied to one terminal of the sub-detection resistor; and a sub-D/A converter configured to digital/analog convert the sub-control value, and to apply a signal thus obtained as a result to the aforementioned one terminal of the sub-detection resistor.

14. The power supply apparatus according to claim 13, wherein the current control unit comprises:

a sub-reference value setting unit configured to generate a sub-reference value which represents a reference value of the auxiliary current; and a sub-digital calculation unit configured to generate the sub-control value by digital calculation such that the digital sub-current measurement value matches the sub-reference value.

15. The power supply apparatus according to claim 14, wherein, when the resistance of the main detection resistor is switched, the power supply apparatus executes:

the sub-reference value setting unit increasing the sub-reference value from zero to the normal-state current reference value, and the main reference value setting unit reducing the current reference value from the normal-state value to zero, while maintaining the sum total of the current reference value and the sub-reference value at the normal-state current reference value;

switching the resistance of the main detection resistor; and the sub-reference value setting unit reducing the sub-reference value from the normal-state current reference value to zero, and the main reference value setting unit increasing the current reference value from zero to the normal-state value, while maintaining the sum total of the current reference value and the sub-reference value at the normal-state current reference value.

16. The power supply apparatus according to claim 15, wherein the sub-path is disconnected in a normal state, and wherein, before the auxiliary current source starts to generate the auxiliary current, the sub-path is switched to a connection state in a state in which the current control unit outputs the sub-control value that is equal to the digital voltage measurement value.

17. The power supply apparatus according to claim 13, wherein the sub-detection resistor is configured as a variable resistor which is capable of switching its resistance, and wherein, when the resistance of the main detection resistor is switched, the resistance of the sub-detection resistor is switched to a higher one of two resistance values between which the resistance value of the main detection resistor is switched.

18. The power supply apparatus according to claim 17, wherein the main detection resistor and the sub-detection resistor have the same circuit topology, and wherein the main detection resistor is configured to be capable of switching its resistance between M resistance values, and wherein the sub-detection resistor is configured to be capable of switching its resistance between (M−1) resistance values.

19. The test apparatus comprising the power supply apparatus according to claim 11, configured to supply electric power to a device under test.

* * * * *